US005125422A

United States Patent [19]

Cheung et al.

[11] Patent Number: 5,125,422

[45] Date of Patent: Jun. 30, 1992

[54] POWER DRIVEN FINGERNAIL POLISHING APPARATUS

[75] Inventors: Chan K. Cheung; Lee T. Chi; Lau Y. Mo, all of Kowloon, Hong Kong

[73] Assignee: Tint International Ltd., Hong Kong

[21] Appl. No.: 789,244

[22] Filed: Nov. 7, 1991

[51] Int. Cl.[5] ..... A45D 29/05

[52] U.S. Cl. ..... 132/73.6; 132/75.8

[58] Field of Search ..... 132/73.6, 75.6, 75.8, 132/76.4

[56] References Cited

U.S. PATENT DOCUMENTS

| | | | |
|---|---|---|---|
| 1,597,025 | 8/1926 | Eger | 132/75.8 |
| 1,672,450 | 6/1928 | De Laitte | 132/75.8 |
| 3,240,966 | 3/1966 | Thompson | 132/73.6 |
| 4,137,926 | 2/1979 | Pao | 132/73.6 |
| 4,896,684 | 1/1990 | Chou | 132/73.6 |
| 5,033,485 | 7/1991 | Hauerwas et al. | 132/73.6 |

FOREIGN PATENT DOCUMENTS

| | | | |
|---|---|---|---|
| 312980 | 10/1929 | United Kingdom | 132/73.6 |

*Primary Examiner*—Gene Mancene
*Assistant Examiner*—Frank A. LaViola
*Attorney, Agent, or Firm*—James A. Wong

[57] ABSTRACT

A motor driven fingernail polishing apparatus comprises a transmission including a drive gear, first and second power transfer gears, battery for driving the motor, combined switch and shift mechanism being selectively shiftable between a central disengaged or off position to a first drive position and to a second drive position wherein the battery is connected to the motor, a first output gear and buffer attached thereto, second output gear and polisher attached thereto, first speed-reducing idler gear operably engaged with the first output gear, additional speed-reducing gear engaged with the second output gear, wherein when the combined switch and shift mechanism is shifted to the first drive position, the first power transfer gear is simultaneously engaged with both the drive gear and the first speed-reducing idler gear with the battery driving the motor, the drive gear, the first power transfer gear, the first speed-reducing idler gear, the first output gear and the buffer; and wherein when the combined switch and shift mechanism is moved to the second drive position, the second power transfer gear is simultaneosuly engaged with both the drive gear and the additional speed-reducing idler gear with the battery driving the motor, the drive gear, the second power transfer gear, the additional speed-reducing idler gear, the second output gear and the polisher.

4 Claims, 4 Drawing Sheets 78
82
74
80
76

POWER DRIVEN FINGERNAIL POLISHING APPARATUS

BACKGROUND OF THE INVENTION

The present invention relates to a fingernail polishing apparatus. Apparatuses presently known to be available for use in manicuring or fingernail polishing include both manually operated and power driven apparatuses. Among the manually operated instruments are metal files, sand boards and emery boards, or the like. Among the power driven type apparatuses for use in nail care are those with sand or emery wheels, discs and pads interchangeably assembled on a shaft driven by a battery actuated motor.

SUMMARY OF THE INVENTION

The present invention relates to a new and improved battery powered fingernail buffing and polishing apparatus. More particularly, the present invention relates to a new and improved multiple function, portable, battery driven buffing and polishing instrument. Multiple functions are provided by a rough buffing tool or element and a fine polishing element incorporated in the disclosed invention, each of which is selectively placed in use at the option of the user. For buffing rough nail portions, a power driven abrasive element is placed in operation and applied to the nail. After rough portions of the nail are fairly smoothened by the abrasive element, the fine polishing tool is then placed in operation and applied to the nail until it is polished to satisfaction. According to the present invention, a relatively coarse abrasive element in the form of a grinding wheel or disc is assembled on a rotary shaft which is driven through a gear train obtaining rotary motion from a battery driven motor and a fine polishing tool in the form of a pad of relatively less coarse material is assembled on a vibrating or reciprocating head driven through a gear train also obtaining motion from the battery driven motion. The present invention also comprises electrical circuitry including a switch member for selectively providing drive to the rotary grinding wheel or the reciprocating polishing pad, or turning the drive motor off. The present invention provides in a single apparatus means affording multiple output including rotary and vibratory or reciprocatory action for selective application to a person's fingernails without changing tools.

BRIEF DESCRIPTION OF THE DRAWINGS

Referring to the drawings, the reader will see that.

DETAILED DESCRIPTION OF THE PREFERRED EMBODIMENT

Figure 4:
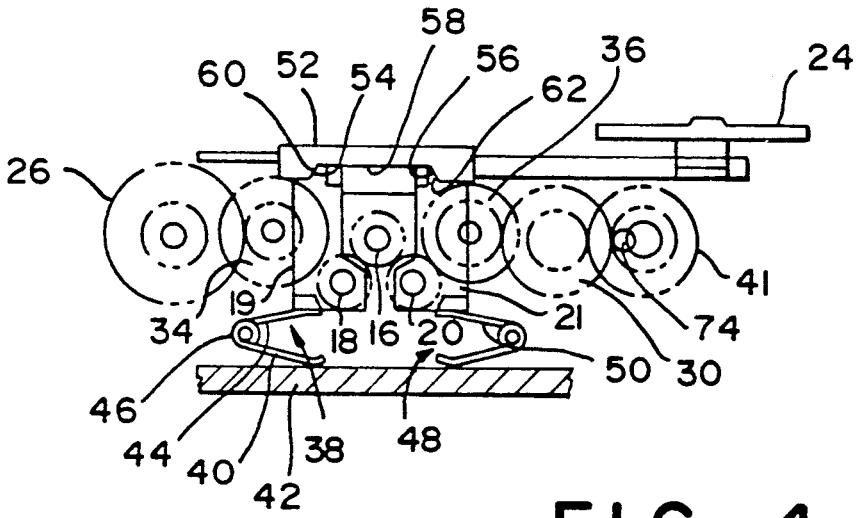
FIGS. 4–6 show gear drive conditions and combined switch and gear shift control mechanism in off position, first drive position, and second drive position.
Figure 5:
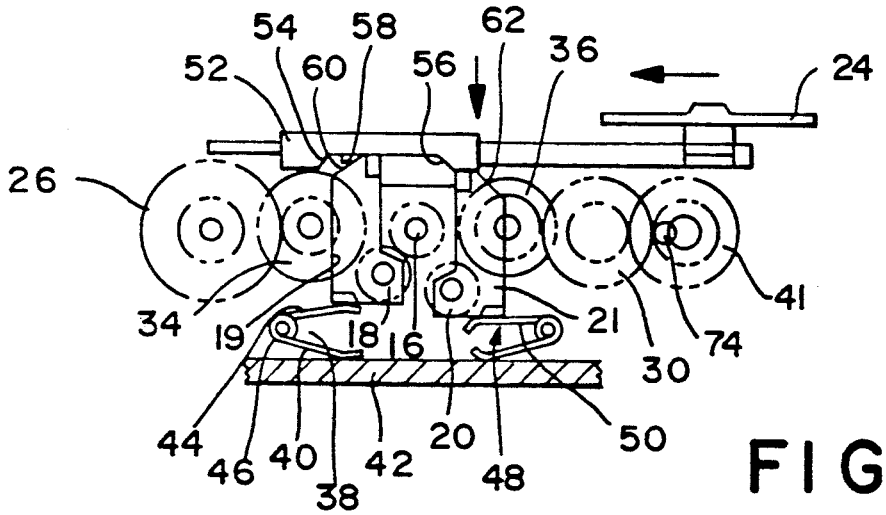
Figure 6:
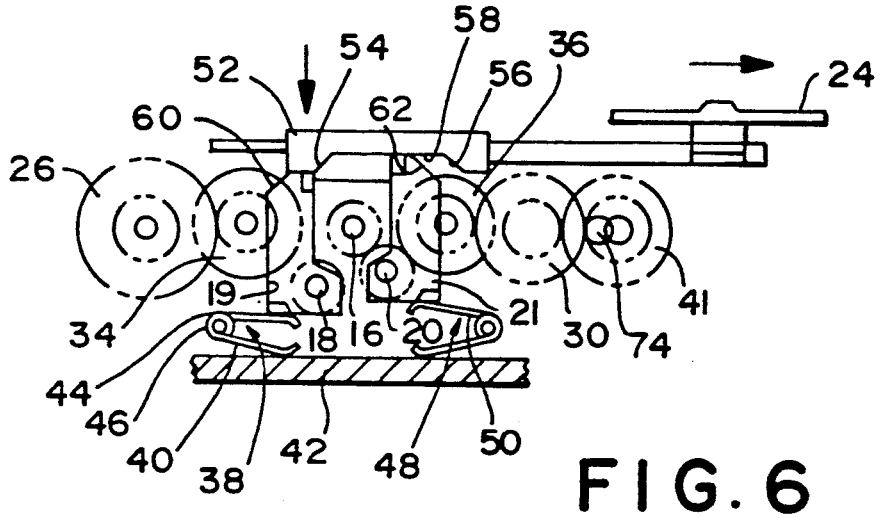
Figures 7A, 7B, 7C, 7D, 7E, 7F, 7G, 7H, 7J:
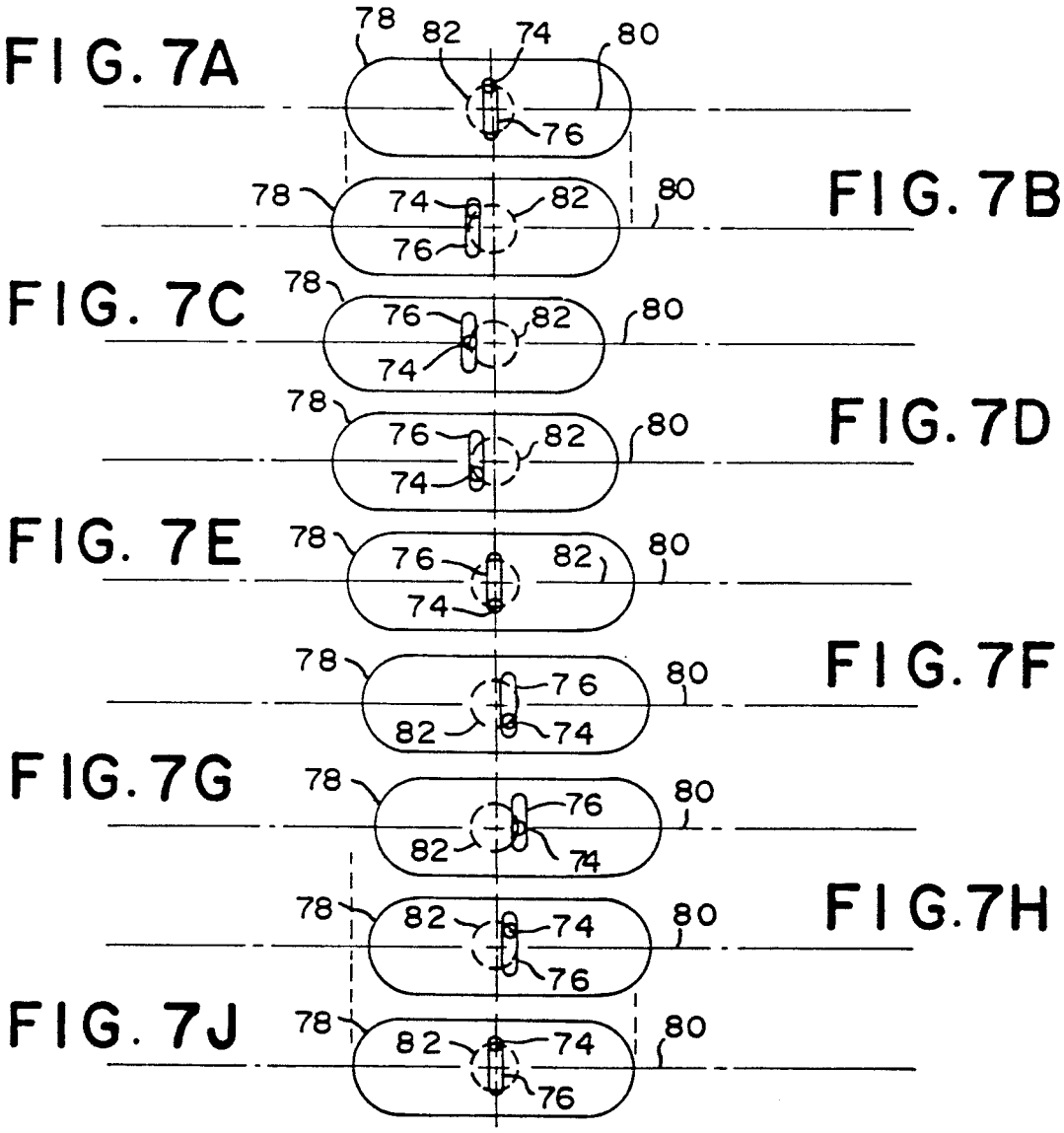
FIG. 7A–7H and 7J show various positions in cycle of vibratory member and rotary member and pin during conversion of rotary motion to reciprocatory motion.

Referring to the drawings in detail, the reader will see that the disclosed inventive concept relates to a power driven fingernail polishing apparatus 10 comprising in combination, an electric motor 12 having a drive shaft 14 and a drive gear 16 on the end of shaft 14, first and second power transfer pinion gears 18, 20, respectively, and an electrical power source in the form of batteries 22, 22 for driving motor 12. Each pinion gear 18 and 20 is separately supported on its own support bracket 19 and 21, respectively. A combined switch and shift mechanism 24 with a control button 25 is provided which is selectively placed in either of three positions to turn off the power, to simultaneously shift first or second power transfer pinion gears 18, 20, respectively, to or from drive engagement. Switch and shift mechanism 24 is selectively movable between a central disengaged or off position to the left as shown in FIGS. 4–6 to a first drive position and to the right to a second drive position wherein batteries 22, 22 are connected to motor 12. A first output gear 26 is provided with a buffing wheel 28 or attached thereto with the latter constituting a first driven tool. A second output gear 30 provides motion to a polishing pad 32 operatively attached thereto and which constitutes a second driven tool.

Figure 1:
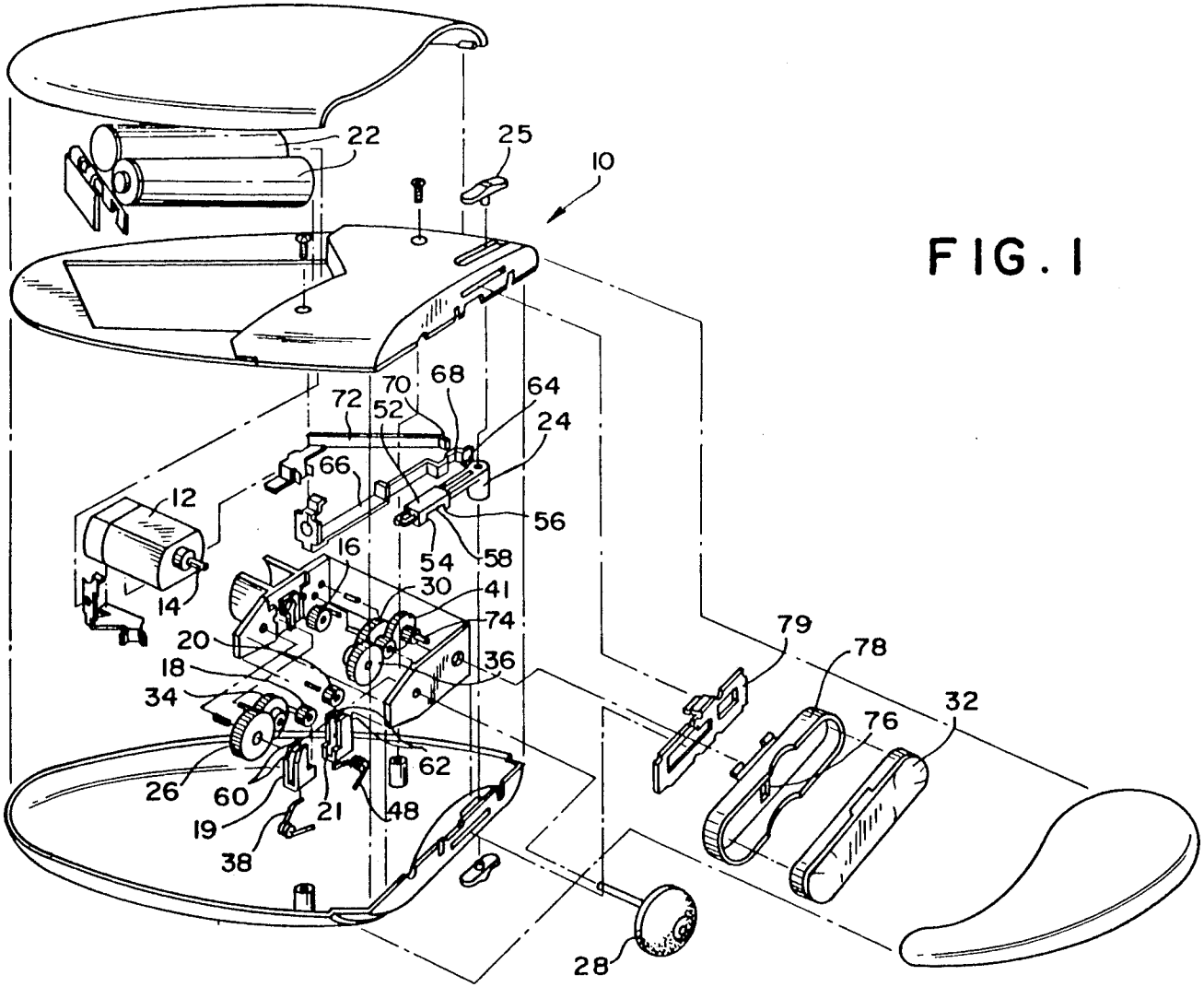
FIG. 1 represents an exploded view in perspective of the disclosed invention.
Figure 3:
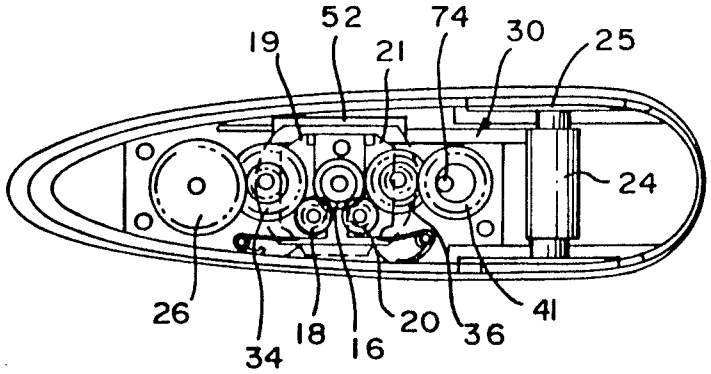
FIG. 3 represents a sectional view taken the plane 3—3 in FIG. 2 to show the gear train for selectively driving a rotary output or a reciprocating output.

Power is transmitted from motor 12 through a first speed-reducing idler gear set 34 operably engaged with first output gear 26. An additional speed-reducing gear 36 is engaged with second output gear 30. When combined switch and shift mechanism 24 is moved to the left to the first drive position, first power transfer gear 18 is simultaneously engaged with both drive gear 16 and first speed-reducing idler gear set 34 with batteries 22, 22 driving motor 12, drive gear 16, first power transfer gear 18, first speed-reducing idler gear set 34, first output gear 26 and buffing wheel 28. Speed-reducing idler gear set 34, as may be seen in FIGS. 1 and 4, comprise a first large diameter surface providing drive from contact with transfer gear 18 and a second small diameter surface imparting drive to first output gear 26 by contact therewith. When combined switch and shift mechanism 24 is moved to the second drive position, second power transfer gear 20 is simultaneously engaged with both drive gear 16 and additional speed-reducing idler gear set 36 with batteries 22, 22 driving motor 12, drive gear 16, second power transfer gear 20, additional speed-reducing idler gear set 36, second output gear 30 and polishing pad 32. Speed-reducing idler gear set 36, not unlike speed-reducing idler gear set 34, comprises a first large diameter surface providing drive from contact with transfer gear 20 and a second small diameter surface imparting drive to second output gear 30 by contact therewith. Because polishing pad 32 is ultimately reciprocated to provide vibratory motion, the rotary motion of second output gear 30 is converted by drive relationship with a further output gear or wheel 41 as further described hereinbelow.

As seen in FIG. 4, in the off position of combined switch and shift mechanism 24, a first spring 38 with a lower leg portion 40 disposed on the housing 42 of the disclosed apparatus 10 and an upper leg portion 44 extending at an acute angle from a joint 46 with the upper leg portion 44 supporting bracket 19 and urging pinion gear 18 upwardly into engagement with drive gear 16. On the opposite side of drive gear 16, a second spring 48 disposed in mirror image to first spring 38 is disposed on housing 42 with an upper leg portion 50 similarly supporting bracket 21 and urging pinion gear 20 into engagement with drive gear 16. When switch and shift mechanism 24 is in the center or off position as shown in FIG. 4, it can be seen to include a bridge portion 52 with a pair of oppositely inclined cam portions 54, 56 and an intermediate recess 58 are formed on the underside thereof. A pair of inclined follower portions 60, 62 which are complementary to cam portions 54, 56 are provided at the upper ends of brackets 19, 21, respectively. In the center or off position of switch mechanism 24, both springs 38, 48 are shown in maximum extended position whereby both pinion gears 18, 20 are urged into engagement with drive gear 16.

Figure 2:
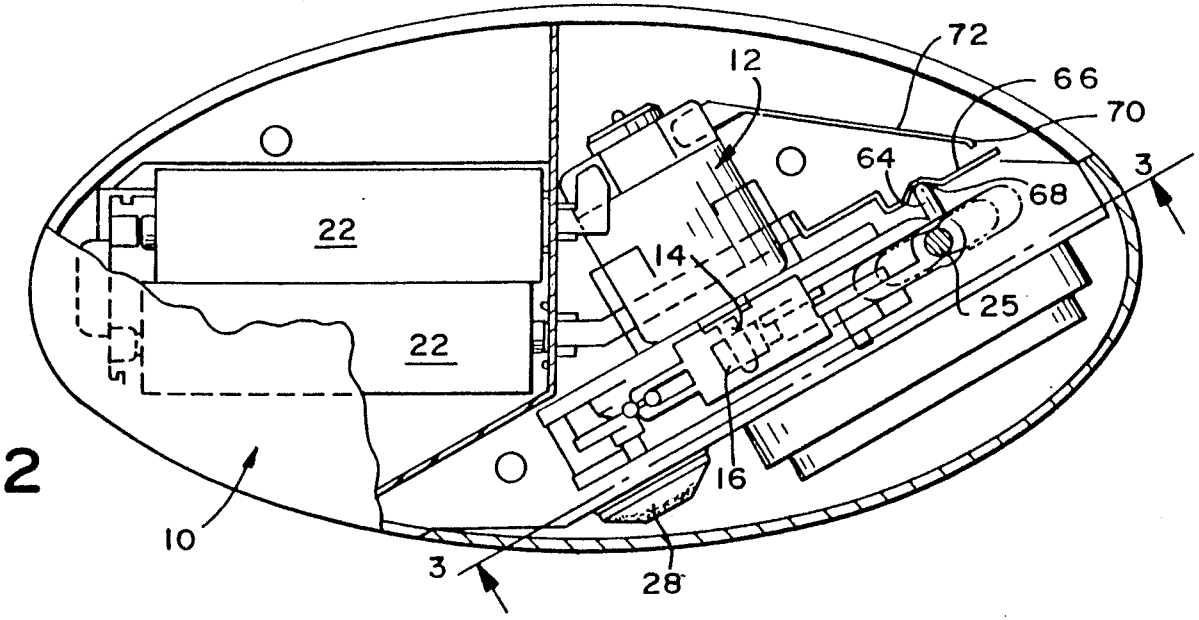
FIG. 2 represents a top plan view of the disclosed invention with a shell or casing portion removed to expose the assembled elements to view.

When combined switch and shift mechanism 24 is moved to the left as seen in FIG. 5, pinion gear 18 remains in engagement with drive gear 16 under the influence of spring 38 which remains extended with follower portion 60 underlying recess 58 of bridge 52 whereby pinion gear 18 is conditioned to transmit drive from gear 16 through gear train 34 to wheel or disk 28. Switch and shift mechanism 24 also includes a contact actuating finger 64 as seen in FIG. 2 for cooperation with contact plate 66 which is electrically connected to batteries 22, 22. Plate 66 includes a downwardly directed concave seat 68 in which finger 64 fits when switch and shift mechanism 24 is in the off position. Finger 64 is to be understood to be of dielectrical material. Located above plate 66 is the terminal 70 of a second contact plate 72 extending from motor 12. As can be seen in FIG. 2, when finger 64 is received in seat 68 during the off condition of switch and shift mechanism 24, terminal 70 and plate 66 are out of contact. It is clear that if switch and shift mechanism 24 is shifted to the left, as shown in FIG. 2, finger 64 will be moved from seat 68 to raise plate 66 into contact with terminal 70 to drive motor 12. When switch and shift mechanism 24 is shifted to the right, finger 64 will move out of seat 68 to raise plate 66 into contact with terminal 70 to drive motor 12.

From structural details described above, it can be readily seen that as switch and shift mechanism 24 is moved to the left, bridge 52 which is constrained to move in the horizontal direction with recess 58 passing over bracket 19 leaving pinion 18 in engagement with drive gear 16, and with the right cam portion 56 riding up follower portion 62 at the upper end of bracket 21 thereby depressing upper leg portion 50 of spring 48 and disengaging pinion gear 20 from drive gear 16, whereby transmission is effected between drive gear 16 and the grinding wheel gear 26 through pinion 18 and gear set 34 with power being furnished to motor 12 from batteries 22, 22 by switch and shift mechanism 24 through simultaneous operation of plate 66 and contact of terminal 70 as described above. Conversely, when, as may be desired for a finishing operation on a person's fingernails, switch and shift mechanism 24 is moved to the right, as in FIG. 6, past the off position so that with bridge 52 still constrained to move in the horizontal direction with recess 58 passing over bracket 21 leaving pinion 20 now in engagement with drive gear 16, and with the left cam portion 54 riding up follower portion 60 at the upper end of bracket 19 thereby depressing upper leg portion 44 of spring 38 and disengaging pinion gear 18 from drive gear 16, whereby transmission is effected between drive gear 16 and the buffing pad gear 30 through pinion 20 and intervening gear set 36 with power being furnished to motor 12 from batteries 22, 22 by switch and shift mechanism 24 through simultaneous operation of plate 66 and terminal 70 of plate 72.

While rough buffing of a person's fingernails would be obtained from the disclosed apparatus 10 on the rotating grinding wheel 28, the fingernails would be finely polished on the vibrating pad 32. While the vibrating motion of pad 32 is reciprocatory in nature, it is also obtained from a rotary motion converted to reciprocatory by the structure illustrated in FIGS. 7A-7H and 7J from which it may be understood from elementary physics that the motion is based upon the principles of simple harmonics. Looking at FIGS. 1 and 2, it can be seen that the output gear and/or wheel 41, which is driven ultimately by motor 12, gear 16, pinion gear 20 and the intervening gear set 36, is formed with a pin 74 projecting transversely from gear or wheel 41 adjacent the periphery thereof. Pin 74 extends into a vertically extending slot 76 formed in slider member 78 disposed in stationary guide 79 with centerline 80 constraining member 78 to slide in the horizontal direction as in FIGS. 7A-7H and 7J. Pin 74 is located on wheel 41 to trace a circle 82 having a diameter not greater than the length of slot 76 so that as pin 74 traces its circle 82, all vertical components of pin 74 are resolved within slot 76 without interference and all horizontal components are imparted to reciprocatory motion or vibration in slider member 78 as constrained along centerline 80. Pin 74 is moved up and down in slot 76, which moves back and forth from left to right, while slide member 78 moves along with slot 76 in reciprocatory manner. Such vibration of slide member 78 is then passed on to the "buffing" pad 32 attached thereto for application to a person's fingernails.

Briefly, it is noted that the invention described above provides a rotary, rough buffing output and a reciprocatory fine polishing output which can be selectively applied, as desired, to a person's fingernails in a single apparatus without requiring change of tools or elements thereof.

It will be apparent to those skilled in the art that various changes may be made without departing from the scope of the invention; and therefore, the invention is not limited to what is shown in the drawings and described in the specification but only as indicated in the appended claims.

What is claimed is:

1. A power driven fingernail polishing apparatus comprising in combination:

a. an electric motor having a drive shaft and drive gear on said shaft;

b. first and second power transfer gears;

c. battery means for driving said motor;

d. first and second shiftable means supporting said first and second power transfer gears, respectively;

e. first and second yieldable means biasing said first and second shiftable means toward engagement with said drive gear;

f. combined switch and shift mechanism including means selectively neutralizing said first and second yieldable biasing means of said first and second power transfer gears, said switch and support mechanism being selectively shiftable between a central disengaged or off position to a first drive position and to a second drive position wherein said battery is connected to said motor;

g. a first output gear and buffing means attached thereto;

h. second output gear and polishing means attached thereto;

i. first speed-reducing idler gear means operably engaged with said first output gear;

j. additional speed-reducing gear means engaged with said second output gear;

wherein when said combined switch and shift mechanism is shifted to said first drive position, said first power transfer gear is simultaneously engaged with both said drive gear and said first speed-reducing idler gear means with said battery driving said motor, said drive gear, said first power transfer gear, said first speed-reducing idler gear means, said first output gear and said buffing means, and said second yieldable biasing means is depressed by said neutralizing means so that said second power transfer gear is out of engagement from said drive gear; and wherein when said combined switch and shift mechanism is shifted to said second drive position, said second power transfer gear is simultaneously engaged with both said drive gear and said additional speed-reducing idler gear means with said battery driving said motor, said drive gear, said second power transfer gear, said additional speed-reducing idler gear means, said second output gear and said polishing means, and said first yieldable biasing means is depressed by said neutralizing means so that said first power transfer gear is out of engagement from said drive gear.

2. The fingernail polishing apparatus as defined in claim 1, wherein a further output gear or wheel is in driving relationship with said second output gear, said further output gear or wheel includes means for converting rotary motion of said further output gear to reciprocating vibratory motion.

3. The fingernail polishing apparatus as defined in claim 2, wherein said further output gear or wheel includes a pin projecting transversely from one side thereof in combination with a slider element having a vertically extending slot extending around said pin, said slider element being supported and constrained to slide in a horizontal direction whereby as said further output gear or wheel is rotatably driven horizontal motion is imparted to said slider element and said polishing means is secured to said slider element.

4. The fingernail polishing apparatus as defined in claim 1, including in combination a stationary first electrical contact plate, a second electrical contact plate with a shiftable contact end and a seat portion on one side thereof, and an actuating finger received in said seat portion, said contact end being out of contact with said first contact plate when said finger is received in said seat portion, and means for selectively moving said finger in either of two directions and out of said seat portion and raising said second contact plate to effect contact of said contact end with said first contact plate.

* * * * *